US008997878B2

(12) United States Patent
Brown et al.

(10) Patent No.: US 8,997,878 B2
(45) Date of Patent: Apr. 7, 2015

(54) SALT RING HANDLING SYSTEM AND METHOD

(75) Inventors: Trevor S. Brown, Magnolia, TX (US); Vincent H. Barone, Huffmen, TX (US)

(73) Assignee: Stingray Offshore Solutions, LLC, Houston, TX (US)

( * ) Notice: Subject to any disclaimer, the term of this patent is extended or adjusted under 35 U.S.C. 154(b) by 794 days.

(21) Appl. No.: 13/231,312

(22) Filed: Sep. 13, 2011

(65) Prior Publication Data

US 2013/0064634 A1 Mar. 14, 2013

(51) Int. Cl.
*E21B 19/00* (2006.01)

(52) U.S. Cl.
CPC ..... *E21B 19/004* (2013.01)

(58) Field of Classification Search
CPC ..... E21B 19/004
USPC ..... 166/360, 341, 345, 351, 352, 85.1; 405/201, 224.2
See application file for complete search history.

(56) References Cited

U.S. PATENT DOCUMENTS 3,043,255 A * 7/1962 Bauer et al. ..... 114/264
3,895,677 A * 7/1975 Bokenkamp ..... 166/359
3,981,369 A * 9/1976 Bokenkamp ..... 175/5
4,007,782 A * 2/1977 Nybo et al. ..... 166/79.1
4,545,437 A * 10/1985 Denison ..... 166/345
4,616,707 A * 10/1986 Langner ..... 166/345
4,617,998 A * 10/1986 Langner ..... 166/345
4,668,126 A * 5/1987 Burton ..... 405/169
4,770,563 A * 9/1988 Pido ..... 405/169
5,148,871 A * 9/1992 Gullion ..... 166/345
5,467,833 A * 11/1995 Crain ..... 175/52
6,343,662 B2 * 2/2002 Byrt et al. ..... 173/4
6,719,062 B2 4/2004 Fikes et al.
7,628,225 B2 * 12/2009 Petersson et al. ..... 175/5
8,522,880 B2 * 9/2013 Roodenburg et al. ..... 166/339
2003/0106695 A1 6/2003 Fikes et al.
2007/0063507 A1 * 3/2007 Reams ..... 285/39
2010/0147528 A1 * 6/2010 Baugh ..... 166/355
2011/0056701 A1 * 3/2011 Jones et al. ..... 166/378
2013/0240214 A1 * 9/2013 Faye ..... 166/345

* cited by examiner

*Primary Examiner* — Matthew Buck

(57) ABSTRACT

A SALT ring handling system having a platform, a track system operatively connected to a lower side of the platform, and a pickle fork operatively connected to the track system. The platform may include an upper deck, a lower deck, a spacer for positioning the deck near a riser, and an engaging mechanism for operatively connecting the platform to a carrier system. The track system may include a vertical track assembly and a horizontal track assembly for transferring the vertical track assembly in a substantially horizontal direction. The vertical track assembly may include a lift mechanism that is operatively connected to the pickle fork, and the lift mechanism may transfer the pickle fork in a substantially vertical direction. The pickle fork may include one or more extensions for engaging a portion of a SALT ring.

20 Claims, 9 Drawing Sheets

SALT RING HANDLING SYSTEM AND METHOD

SUMMARY OF SELECTED EMBODIMENTS OF THE INVENTION

A SALT ring handling system includes a platform, a track system operatively connected to a lower side of the platform, and a pickle fork operatively connected to the track system. The platform may include an engaging mechanism for operatively connecting the platform to a carrier system. The track system may include a vertical track assembly and a horizontal track assembly for transferring the vertical track assembly in a substantially horizontal direction. The pickle fork may be operatively connected to the vertical track assembly. The pickle fork may include an extension for receiving an eyelet of a SALT ring. The vertical track assembly may be capable of transferring the pickle fork in a substantially vertical direction.

The platform may further include an upper deck and a lower deck. The track system may be operatively connected to a lower side of the upper deck. The platform may further include a spacer for positioning the platform near a riser such that the spacer is adjacent to the riser. The SALT ring handling system may further include a storage link for locking the extension of the pickle fork to the spacer of the platform and locking the vertical track assembly and the pickle fork in a substantially parallel position with respect to the platform for storage.

The engaging mechanism may include a guide shoe operatively connected to an end of a leg of the platform extending from a lower side of the upper deck or a lower side of the lower deck. The platform may include two or more legs, each leg extending from the lower side of the upper deck or the lower side of the lower deck to a guide shoe for operatively connecting the platform to a rail of the carrier system. The platform may further include a handrail extending along the periphery of the upper deck and the lower deck. The platform may also include a door in the handrail and a ladder disposed between two of the legs below the door.

The platform may further include one or more lifting eyelets for facilitating lifting of the platform. The vertical track assembly may include a lift mechanism and a frame member having two arms, and the lift mechanism may be slidingly disposed between the two arms. The pickle fork may be operatively connected to the lift mechanism for transferring the pickle fork in a substantially vertical direction along the two arms. The extension of the pickle fork may be disposed between two side extensions of the pickle fork. Each side extension may be for receiving an eyelet of the SALT ring.

The extension of the pickle fork may be dimensioned for engaging an eyelet of a first SALT ring portion, and the SALT ring handling system may further include a second platform, a second track system operatively connected to a lower side of the second platform, and a second pickle fork operatively connected to the second track system. The second platform may include an engaging mechanism for operatively connecting the second platform to the carrier system. The second track system may include a second vertical track assembly and a second horizontal track assembly for transferring the second vertical track assembly in a substantially horizontal direction. The second pickle fork may be operatively connected to the second vertical track assembly. The second pickle fork may include an extension dimensioned to receive an eyelet of a second SALT ring portion. The second vertical track assembly may be capable of transferring the second pickle fork in a substantially vertical direction.

A method for handling a SALT ring may include providing a SALT ring handling system that includes a platform having an engaging mechanism, a track system operatively connected to a lower side of the platform, and a pickle fork operatively connected to the track system. The track system may include a horizontal track assembly and a vertical track assembly. The pickle fork may be operatively connected to the vertical track assembly. The pickle fork may include an extension. The method may also include operatively connecting the engaging mechanism of the platform to a carrier system, and positioning the platform above a SALT ring attached to a parking stand using the carrier system. The method may further include lowering the pickle fork to the SALT ring, engaging the SALT ring with the extension of the pickle fork, disengaging the SALT ring from the parking stand, and lifting the SALT ring attached to the pickle fork using the vertical track assembly and the horizontal track assembly. The method may further include transferring the platform with the SALT ring to a position near a riser using the carrier system such that a spacer of the platform is adjacent to the riser, positioning the SALT ring around the riser using the horizontal track assembly, and locking the SALT ring around the riser.

The method may further include disengaging the extension of the pickle fork from the SALT ring using the horizontal track assembly and the vertical track assembly, and transferring the platform away from the position near the riser using the carrier system. The platform may further include an upper deck and a lower deck, and the engaging mechanism may include a guide shoe operatively connected to an end of a leg of the platform extending from a lower side of the upper deck or a lower side of the lower deck. The method may further include positioning the guide shoe on a rail of the carrier system.

The vertical track assembly may include a lift mechanism slidingly disposed between two arms of a frame member, and the pickle fork may be operatively connected to the lift mechanism. The method may further include lowering the pickle fork to the SALT ring, engaging the SALT ring with the extension of the pickle fork, disengaging the SALT ring from the parking stand, and lifting the SALT ring attached to the pickle fork using the lift mechanism and the horizontal track assembly.

A method for handling a SALT ring may include providing a SALT ring handling system including a first platform having an engaging mechanism, a first track system operatively connected to a lower side of the first platform, a first pickle fork operatively connected to the first track system, a second platform having an engaging mechanism, a second track system operatively connected to a lower side of the second platform, and a second pickle fork operatively connected to the second track system. The first track system may include a first horizontal track assembly and a first vertical track assembly. The first pickle fork may be operatively connected to the first vertical track assembly, and the first pickle fork may include an extension. The second track system may include a second horizontal track assembly and a second vertical track assembly. The second pickle fork may be operatively connected to the second vertical track assembly, and the second pickle fork may include an extension. The method may also include operatively connecting the engaging mechanism of the first platform and the engaging mechanism of the second platform to a carrier system on opposing sides of a riser, positioning the first platform above a first SALT ring portion attached to a first parking stand using the carrier system, and positioning the second platform above a second SALT ring portion attached to a second parking stand using the carrier system.

The method may further include lowering the first pickle fork to the first SALT ring portion, engaging the first SALT ring portion with the extension of the first pickle fork, disengaging the first SALT ring portion from the first parking stand, and lifting the first SALT ring portion attached to the first pickle fork using the first vertical track assembly and the first horizontal track assembly. The method may further include lowering the second pickle fork to the second SALT ring portion, engaging the second SALT ring portion with the extension of the second pickle fork, disengaging the second SALT ring portion from the second parking stand, and lifting the second SALT ring portion attached to the second pickle fork using the second vertical track assembly and the second horizontal track assembly.

The method may further include transferring the first platform with the first SALT ring portion to a first position near the riser using the carrier system such that a first spacer of the first platform is adjacent to the riser. The method may further include transferring the second platform with the second SALT ring portion to a second position near the riser using the carrier system such that a second spacer of the second platform is adjacent to the riser. The method may further include positioning the first SALT ring portion and the second SALT ring portion around the riser using the first horizontal track assembly and the second horizontal track assembly. The method may further include locking the first SALT ring portion to the second SALT ring portion around the riser.

The method may further include disengaging the extension of the first pickle fork from the first SALT ring portion using the first horizontal track assembly and the first vertical track assembly. The method may also include disengaging the extension of the second pickle fork from the second SALT ring portion using the second horizontal track assembly and the second vertical track assembly. The method may further include transferring the first platform away from the first position near the riser and transferring the second platform away from the second position near the riser using the carrier system.

The first platform may further include a first upper deck and a first lower deck, and the engaging mechanism of the first platform may include a first guide shoe operatively connected to an end of a leg of the first platform extending from a lower side of the first upper deck or a lower side of the first lower deck. The second platform may further include a second upper deck and a second lower deck, and the engaging mechanism of the second platform may include a second guide shoe operatively connected to an end of a leg of the second platform extending from a lower side of the second upper deck or a lower side of the second lower deck. The method may further include positioning the first guide shoe and the second guide shoe on opposing sides of the riser on a rail of the carrier system.

The first vertical track assembly may include a first lift mechanism slidingly disposed between two arms of a first frame member. The first pickle fork may be operatively connected to the first lift mechanism. The method may further include lowering the first pickle fork to the first SALT ring portion, engaging the first SALT ring portion with the extension of the first pickle fork, disengaging the first SALT ring portion from the first parking stand, and lifting the first SALT ring portion attached to the first pickle fork using the first lift mechanism and the first horizontal track assembly. The second vertical track assembly may include a second lift mechanism slidingly disposed between two arms of a second frame member. The second pickle fork may be operatively connected to the second lift mechanism. The method may further include lowering the second pickle fork to the second SALT ring portion, engaging the second SALT ring portion with the extension of the second pickle fork, disengaging the second SALT ring portion from the second parking stand, and lifting the second SALT ring portion attached to the second pickle fork using the second lift mechanism and the second horizontal track assembly.

DETAILED DESCRIPTION OF THE PREFERRED EMBODIMENTS

Figure 1:
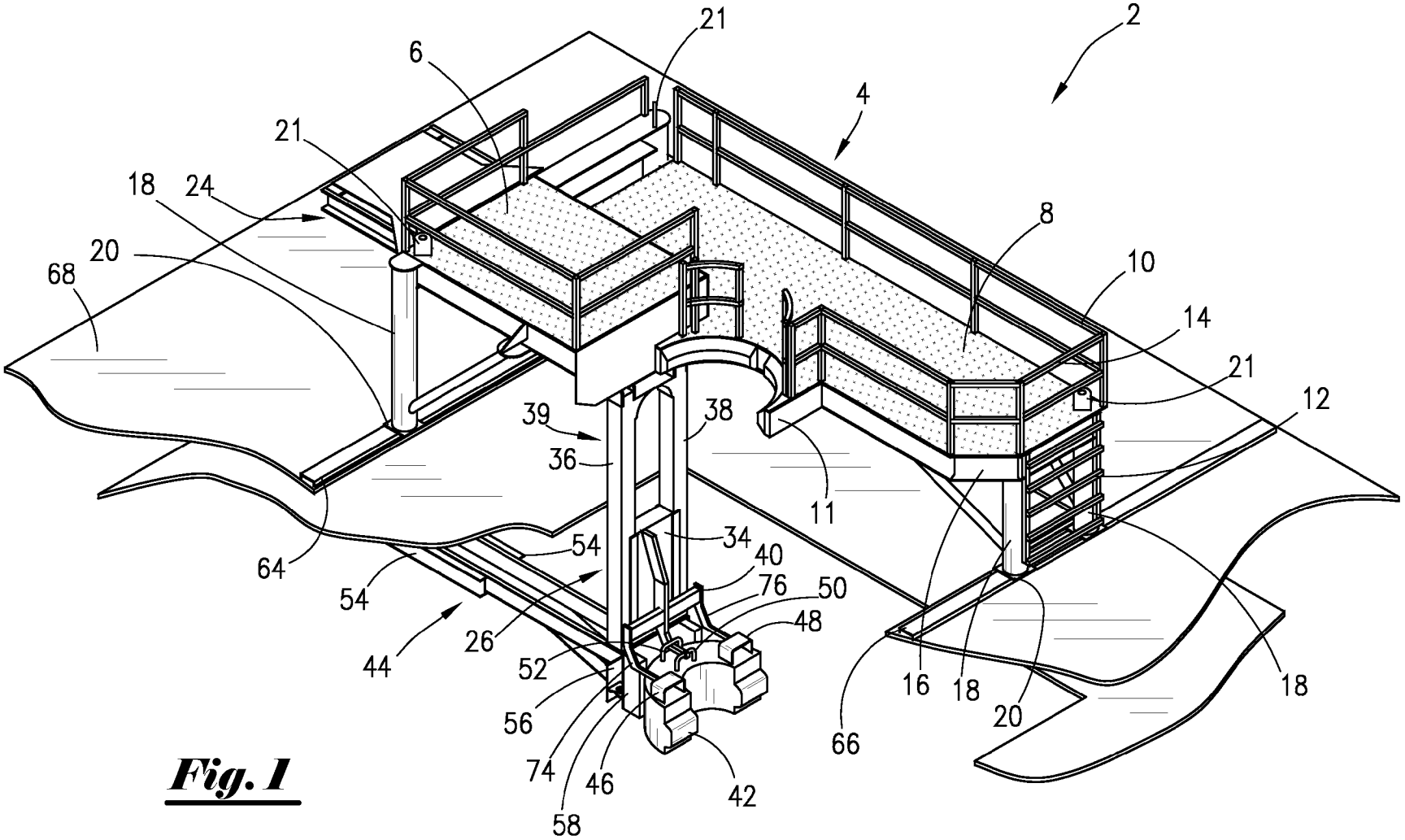
FIG. 1 is a perspective view of a SALT ring handling system.
Figure 2:
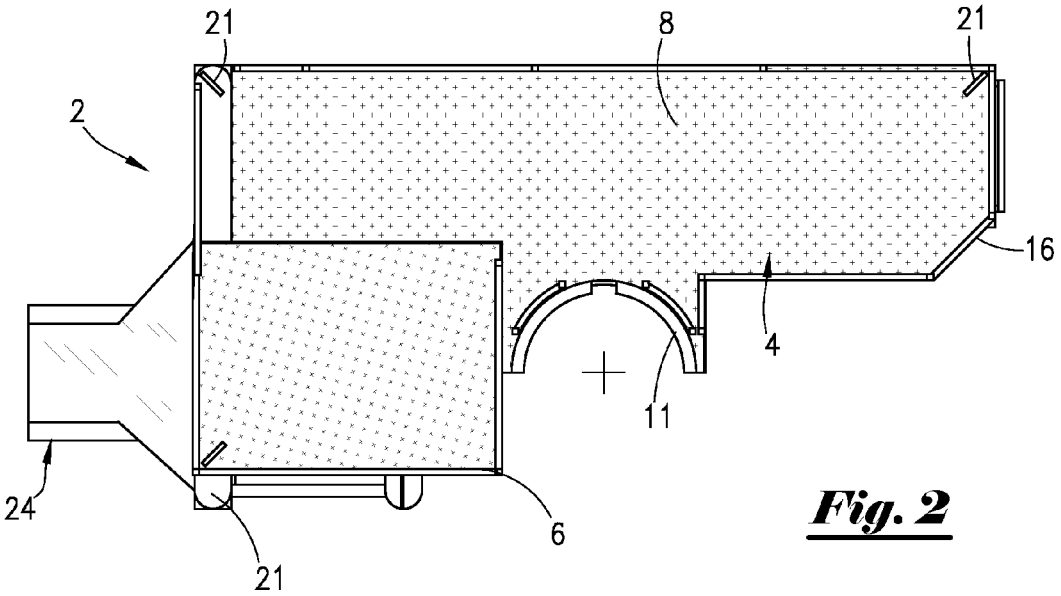
FIG. 2 is a top view of a platform of the SALT ring handling system.
Figure 3:
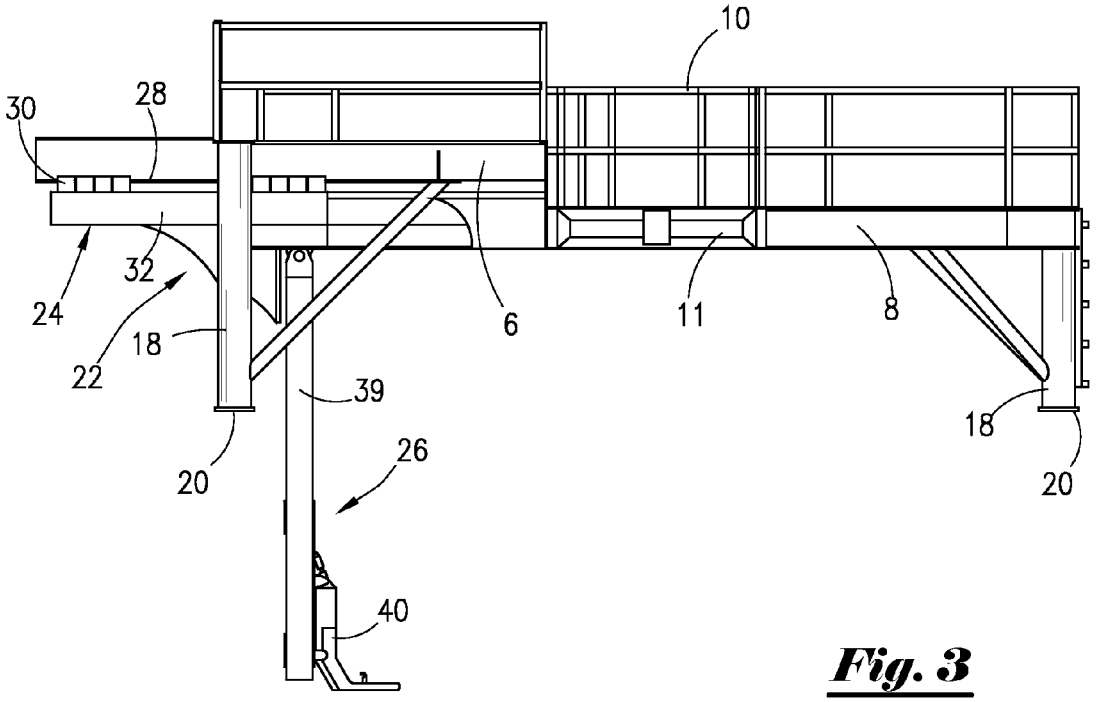
FIG. 3 is a side view of the platform.

A split auxiliary line termination ring (SALT ring) connects to an outer surface of a riser connected to a subsea wellhead. One such SALT ring is offered by Dril-Quip Inc. More specifically, the SALT ring may connect to a telescopic joint of the riser. The SALT ring replaces auxiliary goosenecks for connecting draping lines extending from a drilling rig to rigid auxiliary lines attached to the riser sections. The SALT ring provides for faster attachment of the draping lines to the rigid auxiliary lines. The SALT ring may have two portions that fit around the outer surface of telescopic joint of the riser. The two portions of the SALT ring may connect and lock together around the telescopic joint with hydraulic latches.

FIGS. 1-4 show one half of SALT ring handling system 2. Platform 4 may include upper deck 6 and lower deck 8 having handrails 10 around the perimeter of both decks 6 and 8. Lower deck 8 may include spacer 11 for positioning platform 4 at a position with respect to a sub-sea riser leading to a sub-sea wellhead. In this position, spacer 11 may be adjacent to the riser. Ladder 12 may lead up to door 14, which interconnects handrails 10 on forward end 16 of platform 4. Platform 4 may be supported by legs 18 extending from the lower surfaces of upper deck 6 and lower deck 8 and terminating at guide shoes 20. Guide shoes 20 may provide a mechanism for operatively connecting platform 4 to a rail of a carrier system for moving platform 4. Alternatively, a clevis pin type connection may be used to connect platform 4 to the rail of the carrier system. Platform 4 may further include one or more lifting eyelets 21 for lifting platform 4 (e.g., by crane). Platform 4 may have an overall length of approximately 26 feet and 1 inch. Platform 4 may have an overall width of approximately 12 feet and 2 inches. Platform 4 may have a height from handrail 10 of upper deck 6 to guide shoe 20 of approximately 10 feet and 1 inch, and a height from lower deck 8 to guide shoe 20 of approximately 4 feet and 9 inches. Upper deck 6 and lower deck 8 may be designed to support approximately 100 lbs. per square foot, with a maximum of approximately 4,000 lbs. total.

Track system 22 may be affixed to the lower surface of upper deck 6. Track system 22 may include horizontal track assembly 24 and vertical track assembly 26. Horizontal track assembly 24 may include tracks 28, guides 30 slidingly disposed around each track 28, and base 32 affixed to guides 30 and vertical track assembly 26. Vertical track assembly 26 may include lift mechanism 34 disposed between arms 36 and 38 of frame member 39. Lift mechanism 34 may support pickle fork 40. Lift mechanism 34 may move pickle fork 40 in a substantially vertical direction, and horizontal track assembly 24 may move vertical track assembly 26 with pickle fork 40 in a substantially horizontal direction along tracks 28. Lift mechanism 34 may move pickle fork 40 substantially vertically for a distance of approximately 2 feet. Horizontal track assembly 24 may move vertical track assembly 26 substantially horizontally for a distance of approximately 5 feet and 6 inches. Track system 22 including pickle fork 40 may be designed to handle a 36,000 lb. load. The distance from handrail 10 of upper deck 6 to the bottom of pickle fork 40 may be approximately 20 feet and 2 inches.

The movement of lift mechanism 34 and horizontal track assembly 24 may be hydraulically controlled. The hydraulic power supply may have a capacity of approximately 3,000 psi at 30 gallons per minute. Each platform 4 may have two hoses for attachment to the hydraulic supply. Each hose may have a diameter of approximately 1 inch. Horizontal track assembly 24 may include a hydraulic motor with a rack and pinion for transferring vertical track assembly 26 in a substantially horizontal direction. Plumbing for the hydraulic motor may include tubing and jumper hoses. Horizontal track assembly 24 may also include a spring-center-operated control valve, which is a selector due to a blocked center position. The control valve may have a control handle. Horizontal track assembly 24 may further include two pressure flow control valves for regulating the supply and return of hydraulic fluid, two pilot operated check valves for locking the cylinder in the last operated position, and two relief valves set at approximately 1,800 psi to avoid overloading the structure.

Vertical track assembly 26 may include two hydraulic cylinders for transferring lift mechanism 34 in a substantially vertical direction. Plumbing for the hydraulic cylinders may include tubing and jumper hoses. Vertical track assembly 26 may also include a guide system running on stainless steel and Nylatron sliding pads for low friction and smooth operation, as well as corrosion resistance. Vertical track assembly 26 may also include a spring-center-operated control valve, which is a selector due to a blocked center position. The control valve may have a control handle. Vertical track assembly 26 may further include two pressure flow control valves for regulating the supply and return of hydraulic fluid, two pilot operated check valves for locking the cylinder in the last operated position, and two relief valves set at approximately 1,900 psi to avoid overloading the structure.

Vertical track assembly 26 may further include a tilt hydraulic cylinder for tilting pickle fork 40 up to 10 degrees of rotation. Plumbing for the tilt hydraulic cylinder may include tubing and jumper hoses. Pins may have grease zerks for lubrication. Vertical track assembly 26 may also include a spring-center-operated control valve for the tilt hydraulic cylinder, which is a selector due to a blocked center position. The control valve may have a control handle. For the tilt hydraulic cylinder, vertical track assembly 26 may further include two pressure flow control valves for regulating the supply and return of hydraulic fluid, two pilot operated check valves for locking the cylinder in the last operated position, and two relief valves set at approximately 2,200 psi to avoid overloading the structure.

Alternatively, movement of lift mechanism 34 and horizontal track assembly 24 may be controlled electronically or pneumatically. Each platform 4 may further include a control panel with controls designed to allow an operator on each platform 4 to control the movement of horizontal track assembly 24 and vertical track assembly 26. The control panel may be located on lower deck 8. Alternatively, the control panel may be located on upper deck 6.

Platform 4, track system 22, and pickle fork 40 may be formed of carbon steel or another material having a strength sufficient to bear the loads discussed above.

Through the movements of lift mechanism 34 and horizontal track assembly 24, pickle fork 40 may engage and lift SALT ring portion 42 from parking stand 44. More specifically, pickle fork 40 may engage side eyelets 46 and 48, center eyelet 50, and rear eyelet 52 of SALT ring portion 42. Parking stand 44 may include supports 54, passage 56, and engaging member 58. SALT ring portion 42 may be attached to engaging member 58 of parking stand 44 for storage. Passage 56 may be dimensioned to receive an end of pickle fork 40 for removing SALT ring portion 42 from engaging member 58 of parking stand 44.

Figure 6:
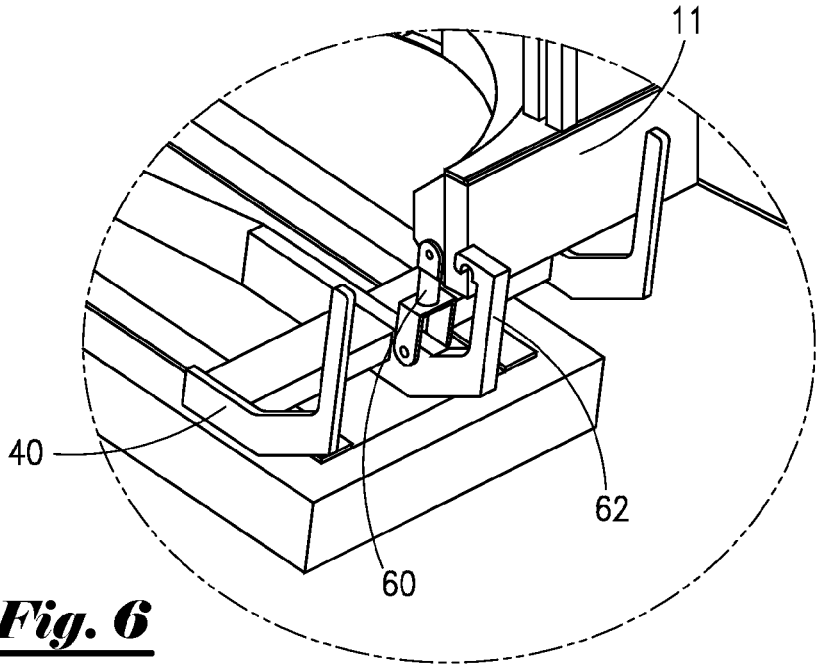
FIG. 6 is a perspective view of a storage link of the platform taken from area 6 in FIG. 5.
Figure 5:
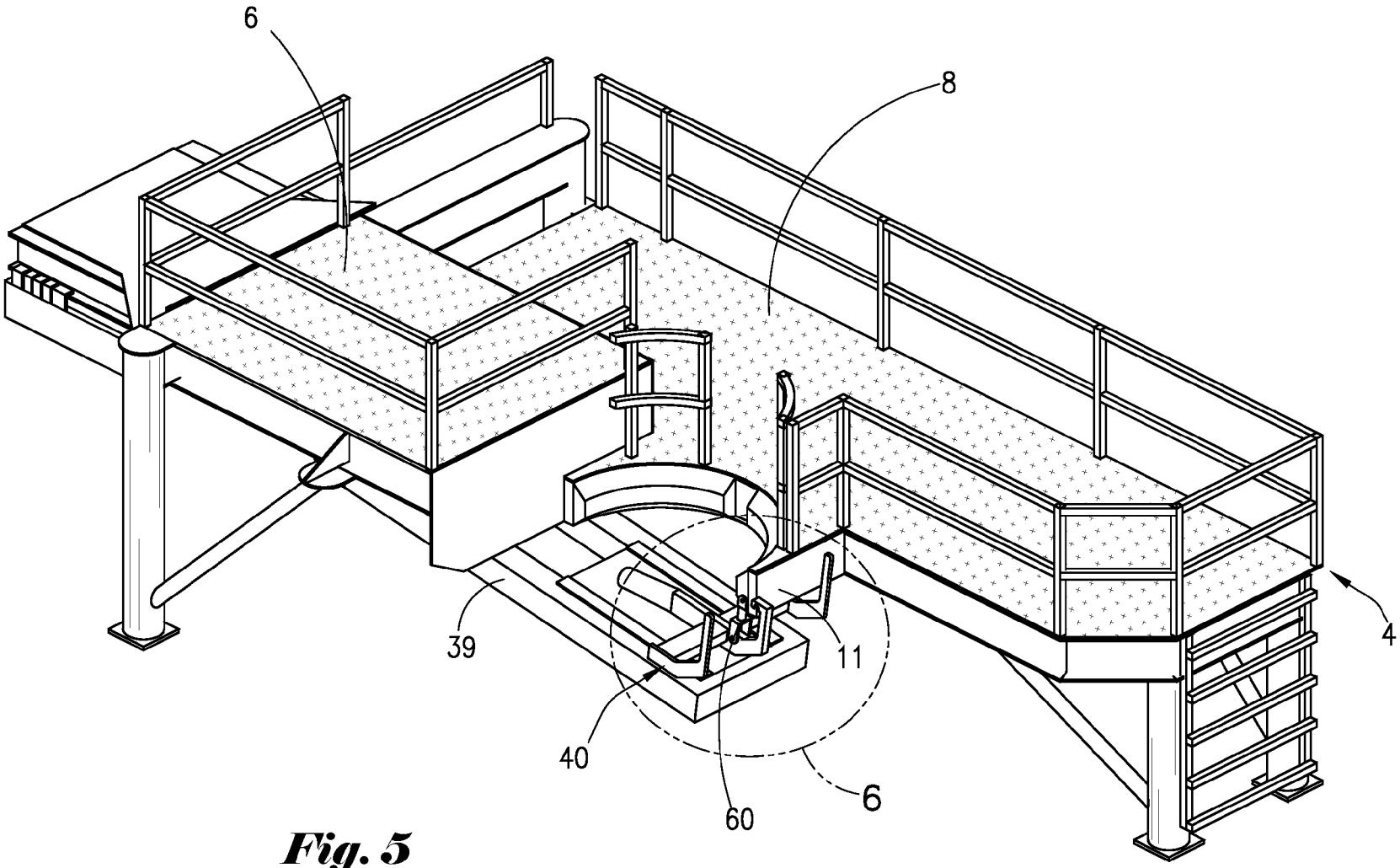
FIG. 5 is a perspective view of the SALT ring handling system in a storage position.
Figure 7:
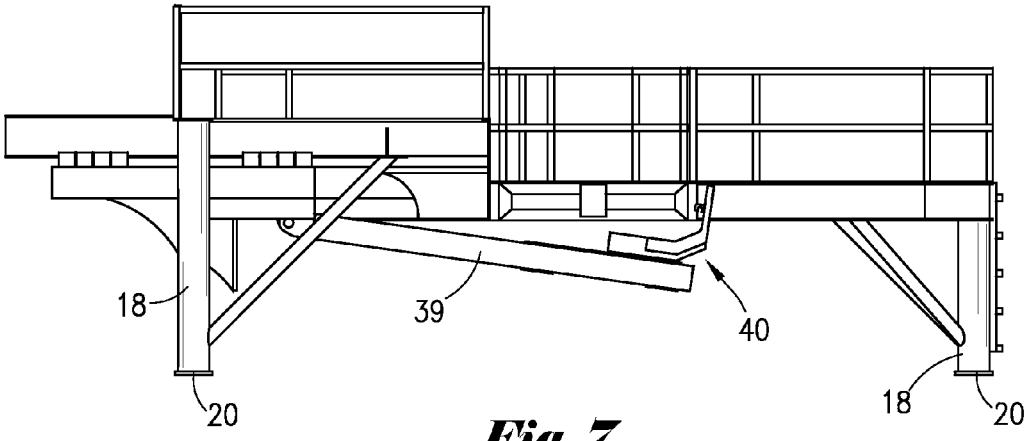
FIG. 7 is a side view of the platform in the storage position.
Figure 8:
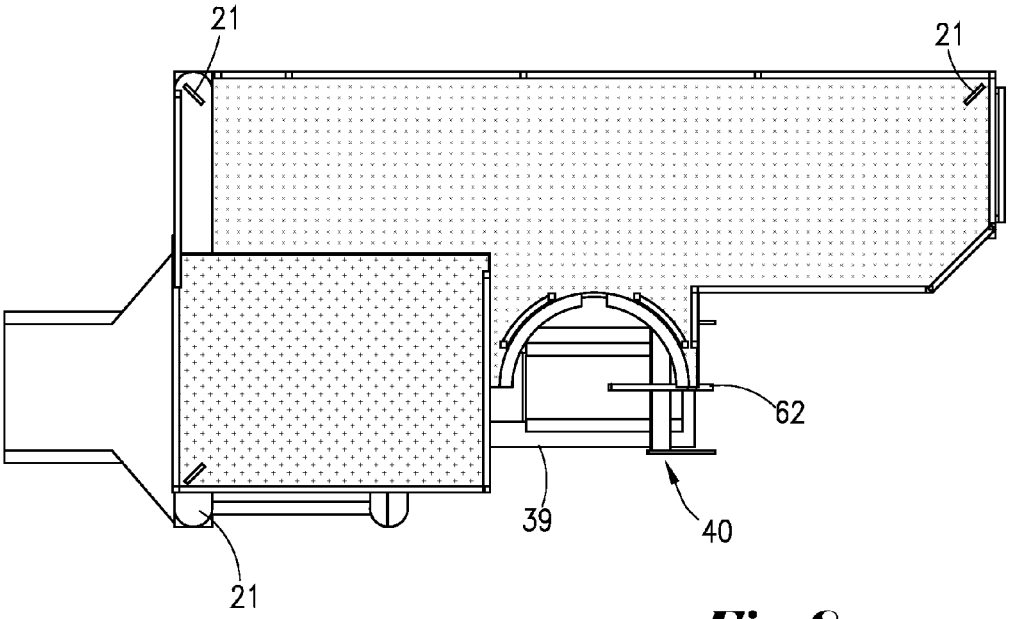
FIG. 8 is a top view of the platform in the storage position.

Referring now to FIGS. 5-8, frame member 39 of vertical track assembly 26 may be folded into a substantially horizontal position as shown for storage or transportation. Alternatively, vertical track assembly 26 may be folded into a substantially parallel position with respect to platform 4. Storage link 60 may extend from platform 4. In FIG. 6, storage link 60 extends from spacer 11 of platform 4. Storage link 60 may engage pickle fork 40 such that frame member 39 is locked in the horizontal or parallel position. For example, a bolt or screw may engage a bore through center extension 62 of pickle fork 40 as shown in FIG. 6. System 2 may have a total weight of approximately 22,000 lbs.

Figure 9:
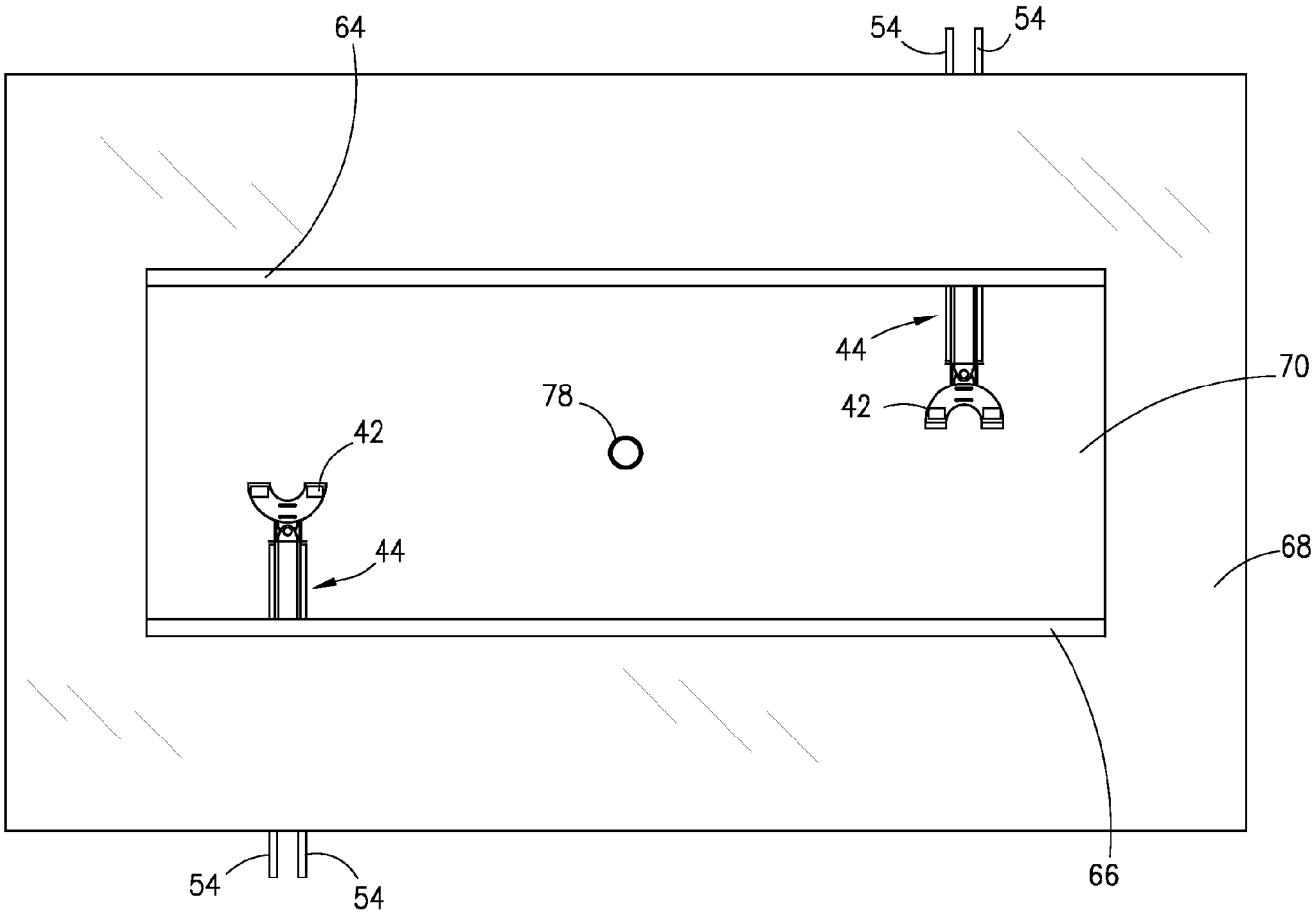
FIG. 9 is a plan view of portions of a SALT ring each held by a parking stand below a moon deck of a drilling rig.

As shown in FIG. 9, SALT ring portions 42 may be positioned on parking stands 44 below moon deck 68 of a drilling rig with SALT ring portions 42 positioned in rail space 70, i.e., the space between rails 64 and 66 of a carrier system on moon deck 68. The carrier system may be a BOP carrier system existing on moon deck 68. Alternatively, the carrier system may include a ratchet style gripper system, a pancake style gripper system, or a gear rack system, and may be powered by the hydraulic control, electronic control, or pneumatic control of track systems 22 on platforms 4. Supports 54 of parking stands 44 may extend or retract SALT ring portions 42 into or out of rail space 70. SALT ring portions 42 may be extended approximately 6 feet and 8 inches into rail space 70. Rails 64 and 66 may each have a width of approximately 9 inches, and may be spaced approximately 20 feet and 3 inches apart.

Figure 10:
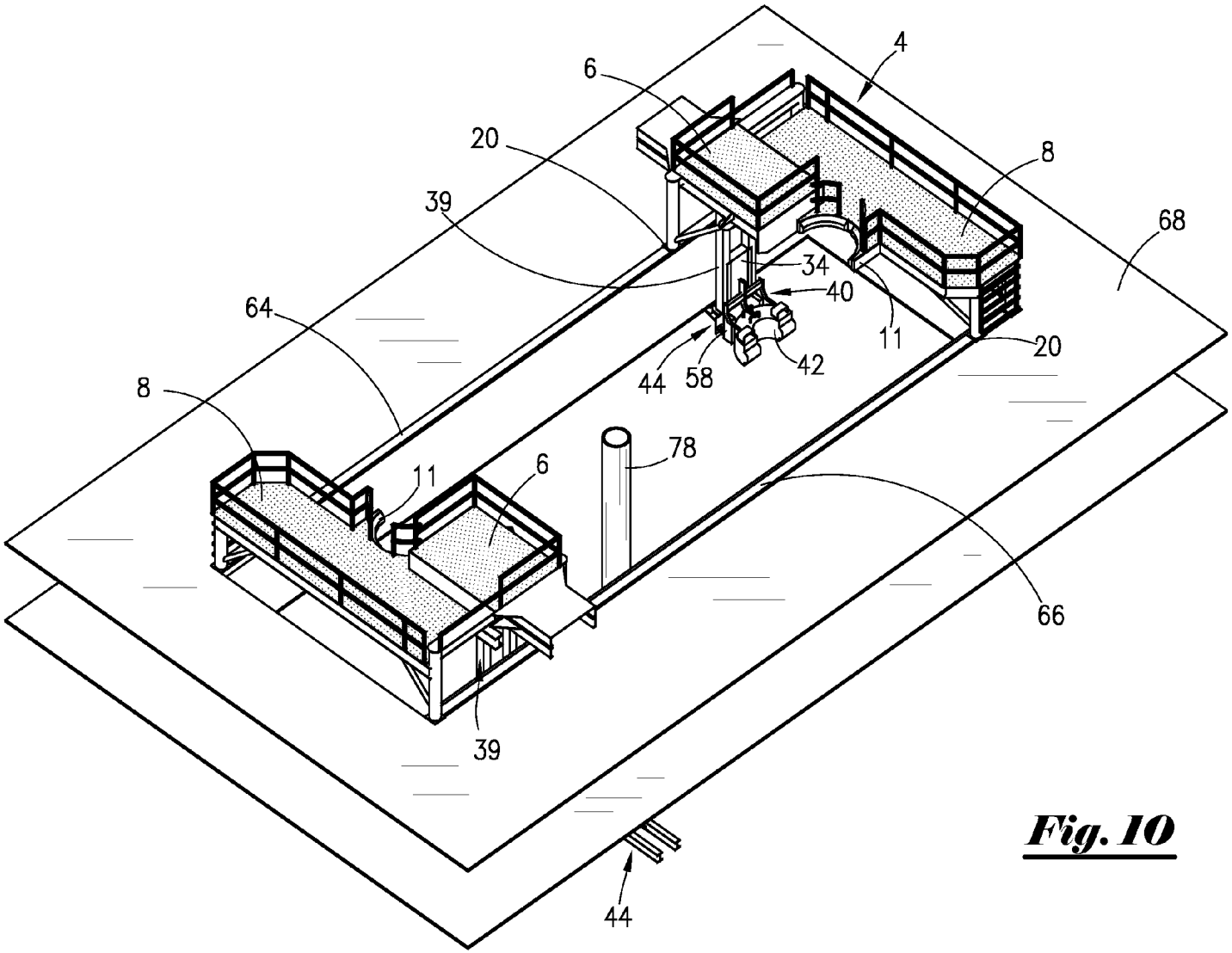
FIG. 10 is a perspective view of the SALT ring handling system engaging the SALT ring portions supported by the parking stands.

With reference now to FIG. 10, platforms 4 may be positioned on rails 64 and 66. Guide shoes 20 (not shown) may engage rails 64 and 66. Alternatively, guide plates may be used to engage rails 64 and 66. The carrier system may be used to move platforms 4 on rails 64 and 66 until upper decks 6 are positioned over SALT ring portions 42 as shown.

Figure 4:
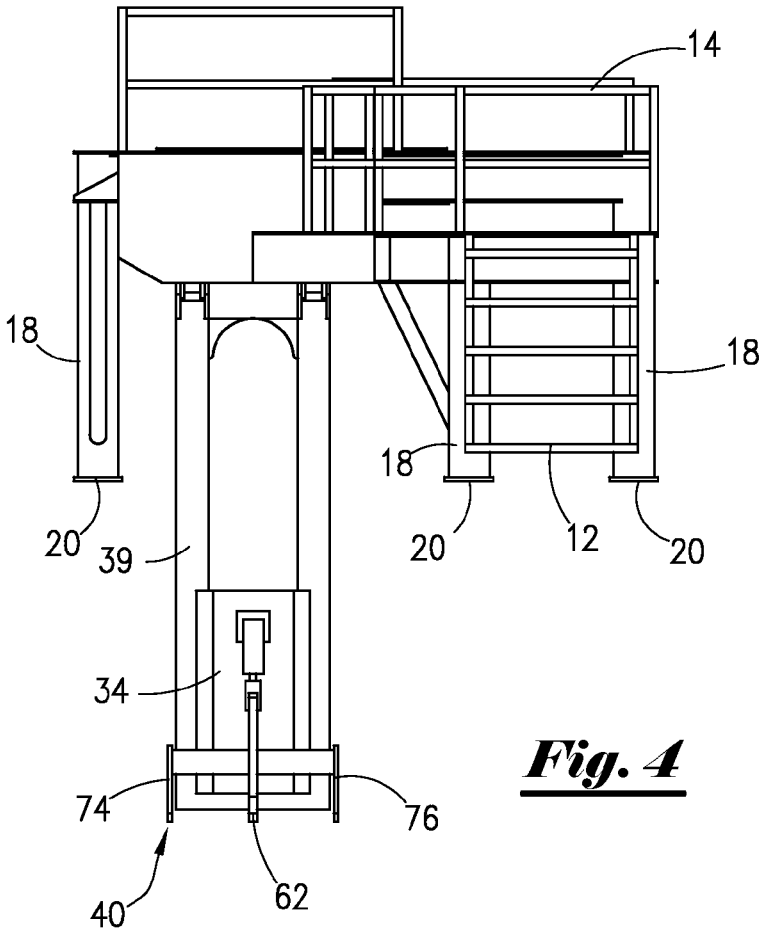
FIG. 4 is a front view of the platform.

Horizontal track assemblies 24 and lift mechanisms 34 may be used to engage SALT ring portions 42 with pickle forks 40. Specifically, each pickle fork 40 may be lowered on lift mechanisms 34 until center extension 62 and side extensions 74, 76 (shown in FIGS. 1 and 4) of each pickle fork 40 are vertically aligned with eyelets 46, 48, 50, 52 of each SALT ring portion 42. Each horizontal track assembly 24 may be used to extend each pickle fork 40 through eyelets 46, 48, 50, 52 until center extension 62 of each pickle fork 40 contacts rear eyelet 52 of each SALT ring portion 42. Each lift mechanism 34 may then be used to lift each pickle fork 40 until center extension 62 of each pickle fork 40 contacts center eyelet 50 of each SALT ring portion 42. Each horizontal track assembly 24 may then be used to retract each pickle fork 40 until a lip of center extension 62 of each pickle fork 40 contacts center eyelet 50 of each SALT ring portion 42. Each lift mechanism 34 may then be used to again lift each pickle fork 40 until center eyelet 50 of each SALT ring portion 42 engages a depression in center extension 62 of each pickle fork 40. In this way, center extension 62 of each pickle fork 40 engages rear eyelet 52 and center eyelet 50 of each SALT ring portion 42, and side extensions 74, 76 of each pickle fork 40 engages side eyelets 46, 48 of each SALT ring portion 42 (as shown in FIGS. 1 and 4). A lock on each parking stand 44 may be released, and each SALT ring portion 42 may be lifted using each lift mechanism 34 to remove each SALT ring portion 42 from engaging member 58 of each parking stand 44.

Figure 11:
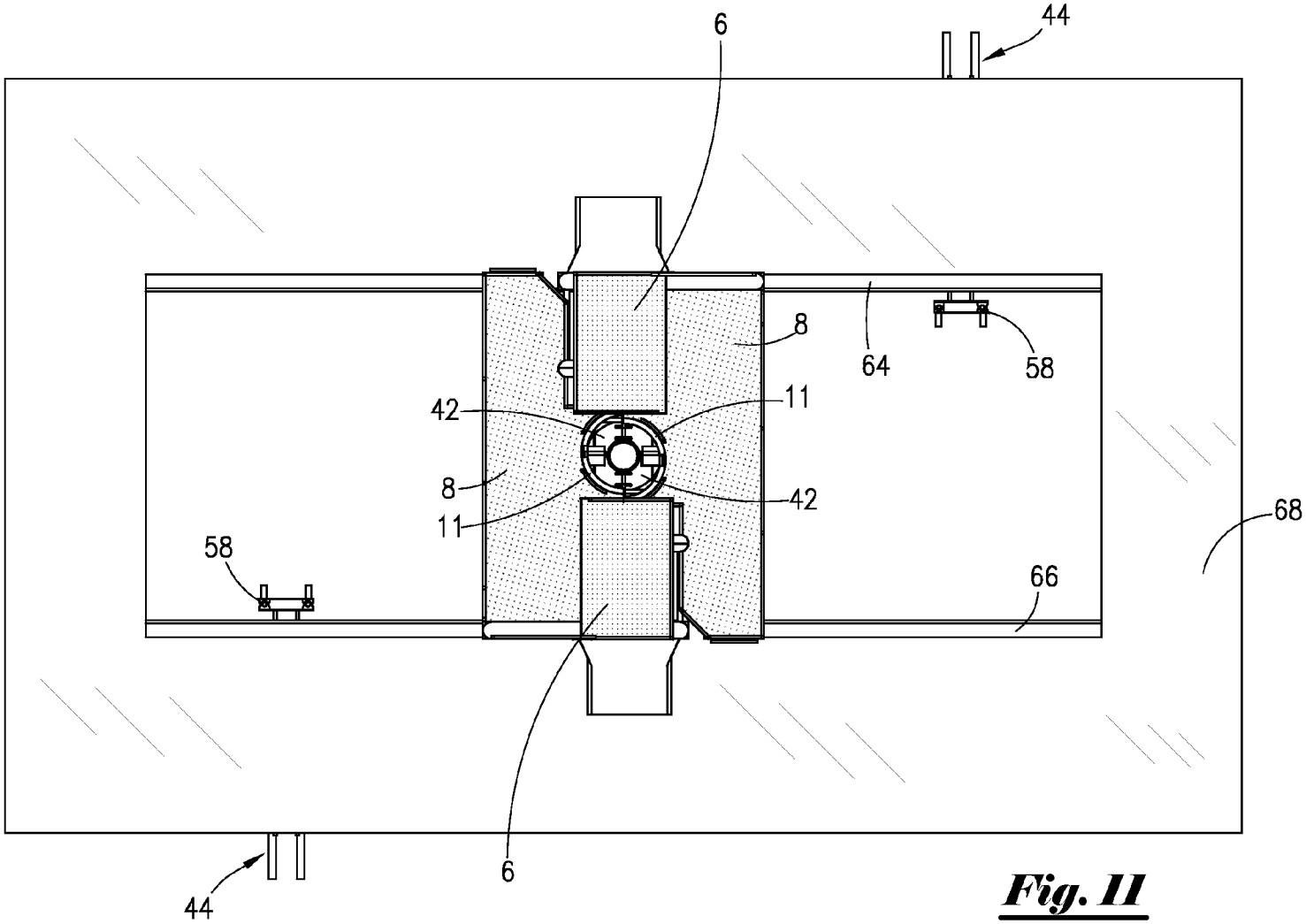
FIG. 11 is a plan view of the SALT ring handling system and the SALT ring portions positioned at the riser in the rail space of the moon deck.
Figure 12:
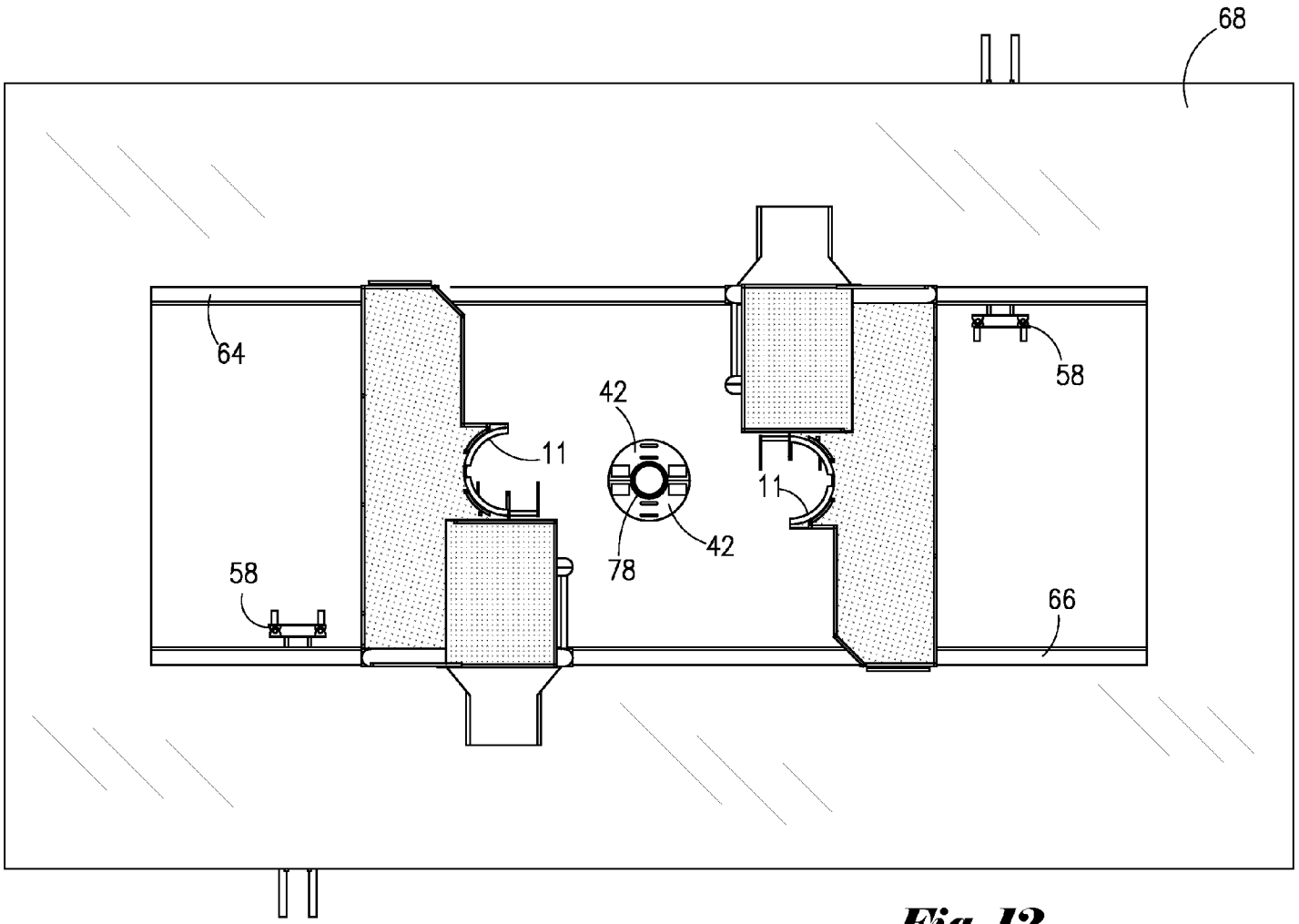
FIG. 12 is a plan view of the SALT ring portions positioned on the riser in the rail space of the moon deck.

As shown in FIG. 11, platforms 4 may then be moved along rails 64 and 66 until spacers 11 are adjacent to riser 78 as shown in FIG. 12. Horizontal track assemblies 24 may then be used to move SALT ring portions 42 on pickle forks 40 toward riser 78 until SALT ring portions 42 engage riser 78 and one another. Riser 78 may need to be rotated and adjusted vertically for alignment with SALT ring portions 42 before horizontal track assemblies 24 are used to move SALT ring portions 42 toward riser 78.

SALT ring portions 42 may be locked together as shown in FIG. 12 to form a SALT ring. Center and side extensions 62, 74, 76 of pickle forks 40 may be removed from center, rear, and side eyelets 50, 52, 46, 48 of each SALT ring portion 42. Thereafter, platforms 4 may be moved away from riser 78 on rails 64 and 66 with the carrier system. Parking stands 44 may be positioned a distance along rails 64 and 66 from the center of riser 78 of at least approximately 20 feet.

Alternatively, one platform 4 may be used to handle the entire SALT ring by transferring the SALT ring from parking stand 44 to riser 78 and locking the SALT ring around riser 78.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A handling system for use with an offshore drilling rig, said rig having a moon deck and vertically supporting a marine riser passing through said moon deck, said marine riser including a telescopic joint and carrying an auxiliary line, said rig removably carrying a split auxiliary line termination ring that is structured to be removably fixed about said telescopic joint to couple an upper end of said auxiliary line to a flexible draping line, the handling system comprising:

a platform having an engaging mechanism for operatively connecting said platform to a carrier system arranged to be located on said moon deck;

a track system operatively connected to a lower side of said platform, said track system having a vertical track assembly and a horizontal track assembly for transferring said vertical track assembly in a substantially horizontal direction; and a pickle fork operatively connected to said vertical track assembly, said pickle fork adapted for carrying said split auxiliary line termination ring, wherein said vertical track assembly is capable of transferring said pickle fork in a substantially vertical direction.

2. The handling system of claim 1, wherein said platform further comprises an upper deck and a lower deck, wherein said track system is operatively connected to a lower side of said upper deck.

3. The handling system of claim 2, wherein said platform further comprises a spacer for positioning said platform near said marine riser such that said spacer is adjacent to said marine riser.

4. The handling system of claim 3, further comprising a storage link for locking said pickle fork to said spacer of said platform and locking said vertical track assembly and said pickle fork in a substantially parallel position with respect to said platform for storage.

5. The handling system of claim 2, wherein said engaging mechanism comprises a guide shoe operatively connected to an end of a leg of said platform extending from a lower side of said upper deck or a lower side of said lower deck.

6. The handling system of claim 5, wherein said platform further comprises two or more legs, each leg extending from said lower side of said upper deck or said lower side of said lower deck to a guide shoe for operatively connecting said platform to a rail of said carrier system.

7. The handling system of claim 6, wherein said platform comprises a handrail extending along the periphery of said upper deck and said lower deck, and wherein said platform further comprises a door in said handrail, and a ladder disposed between two of said legs below said door.

8. The handling system of claim 1, wherein said platform further comprises one or more lifting eyelets for facilitating lifting of said platform.

9. The handling system of claim 1, wherein said vertical track assembly comprises a lift mechanism and a frame member having two arms, said lift mechanism slidingly disposed between said two arms, and wherein said pickle fork is operatively connected to said lift mechanism for transferring said pickle fork in a substantially vertical direction along said two arms.

10. The handling system of claim 1, wherein said pickle fork includes two side extensions, each of said side extensions dimensioned for receiving an eyelet of said split auxiliary line termination ring.

11. The handling system of claim 1, wherein said pickle fork is dimensioned for engaging an eyelet of a first split auxiliary line termination ring portion; and wherein said handling system further comprises:

a second platform including an engaging mechanism for operatively connecting said second platform to said carrier system;

a second track system operatively connected to a lower side of said second platform, said second track system including a second vertical track assembly and a second horizontal track assembly for transferring said second vertical track assembly in a substantially horizontal direction; and a second pickle fork operatively connected to said second vertical track assembly, said second pickle fork dimensioned for receiving an eyelet of a second split auxiliary line termination ring portion, wherein said second vertical track assembly is capable of transferring said second pickle fork in a substantially vertical direction.

12. A method for terminating an auxiliary line carried by a marine riser and vertically suspended through a moon deck of an offshore drilling rig, the method comprising the steps of:

(a) removably carrying a split auxiliary line termination ring by a parking stand of said rig;

(b) operatively connecting an engaging mechanism of a platform to a carrier system located on said moon deck;

(c) positioning said platform above said split auxiliary line termination ring using said carrier system;

(d) lowering a pickle fork carried by said platform, engaging said split auxiliary line termination ring with said pickle fork and lifting said split auxiliary line termination ring with said pickle fork; then (e) moving said platform to a position near said marine riser using said carrier system;

(f) positioning said split auxiliary line termination ring around said marine riser using a horizontal track assembly; and (g) locking said split auxiliary line termination ring around said marine riser.

13. The method of claim 12, further comprising the steps of:

(h) disengaging said pickle fork from said split auxiliary line termination ring using said horizontal track assembly and a vertical track assembly; and (i) transferring said platform away from said position near said marine riser using said carrier system.

14. The method of claim 12, wherein step (b) further comprises: positioning a guide shoe on a rail of said carrier system.

15. The method of claim 12, wherein:

said pickle fork is operatively connected to a lift mechanism carried by a vertical track assembly, said lift mechanism slidingly disposed between two arms of a frame member; and step (d) further comprises engaging said split auxiliary line termination ring with said pickle fork, disengaging said split auxiliary line termination ring from said parking stand, and lifting said split auxiliary line termination ring by said pickle fork using said lift mechanism and said horizontal track assembly.

16. A method for terminating an auxiliary line carried by a marine riser and vertically suspended through a moon deck of an offshore drilling rig, the method comprising the steps of:

(a) providing a handling system comprising first and second platforms each having an engaging mechanism, a track system operatively connected to a lower side of said platform with horizontal and vertical track assemblies, and a pickle fork operatively connected to said vertical track assembly;

(b) operatively connecting said engaging mechanism of said first platform and said engaging mechanism of said second platform to a carrier system on opposing sides of said marine riser;

(c) positioning said first platform above a first split auxiliary line termination ring portion attached to a first parking stand and positioning said second platform above a second split auxiliary line termination ring portion attached to a second parking stand using said carrier system;

(d) disengaging and lifting said first split auxiliary line termination ring portion from said first parking stand by said pickle fork of said first platform using said vertical and horizontal track assemblies of said first platform;

(e) disengaging and lifting said second split auxiliary line termination ring portion from said second parking stand by said pickle fork of said second platform using said vertical and horizontal track assemblies of said second platform;

(f) transferring said first platform with said first split auxiliary line termination ring portion to a first position near said marine riser using said carrier system;

(g) transferring said second platform with said second split auxiliary line termination ring portion to a second position near said marine riser using said carrier system;

(h) positioning said first split auxiliary line termination ring portion and said second split auxiliary line termination ring portion around said marine riser using said horizontal track assemblies of said first and second platforms, respectively; and (i) locking said first split auxiliary line termination ring portion to said second split auxiliary line termination ring portion around said marine riser.

17. The method of claim 16, further comprising the steps of:

(j) disengaging said pickle fork of said first platform from said first split auxiliary line termination ring portion using said horizontal track assembly and said vertical track assembly of said first platform;

(k) disengaging said second pickle fork of said second platform from said second split auxiliary line termination ring portion using said horizontal track assembly and said vertical track assembly of said second platform; and (l) transferring said first platform away from said first position near said marine riser and said second platform away from said second position near said marine riser using said carrier system.

18. The method of claim 16, wherein said first platform further comprises a first upper deck and a first lower deck, wherein said engaging mechanism of said first platform comprises a first guide shoe operatively connected to an end of a leg of said first platform extending from a lower side of said first upper deck or a lower side of said first lower deck, wherein said second platform further comprises a second upper deck and a second lower deck, wherein said engaging mechanism of said second platform comprises a second guide shoe operatively connected to an end of a leg of said second platform extending from a lower side of said second upper deck or a lower side of said second lower deck, and wherein step (b) further comprises: positioning said first guide shoe and said second guide shoe on opposing sides of said marine riser on a rail of said carrier system.

19. The method of claim 16, wherein:

said vertical track assemblies of said first and second platforms each include a lift mechanism slidingly disposed between two arms of a frame member, said pickle fork being operatively connected to said lift mechanism;

step (d) further comprises lifting said first split auxiliary line termination ring portion using said lift mechanism and said horizontal track assembly of said first platform; and step (e) further comprises lifting said second split auxiliary line termination ring portion using said lift mechanism and said horizontal track assembly of said second platform.

20. An offshore drilling rig comprising:

a moon deck;

a marine riser passing through said moon deck and vertically supported by said rig, said marine riser including a telescopic joint and carrying an auxiliary line;

a split auxiliary line termination ring removably carried by said rig, said split auxiliary line termination ring being structured to be removably fixed about said telescopic joint to couple an upper end of said auxiliary line to a flexible draping line;

a platform having an engaging mechanism for operatively connecting said platform to a carrier system arranged to be located on said moon deck;

a track system operatively connected to a lower side of said platform, said track system having a vertical track assembly and a horizontal track assembly for transferring said vertical track assembly in a substantially horizontal direction; and a pickle fork operatively connected to said vertical track assembly, said pickle fork adapted for carrying said split auxiliary line termination ring, wherein said vertical track assembly is capable of transferring said pickle fork in a substantially vertical direction.

* * * * *